US008268089B2

(12) United States Patent
Classen et al.

(10) Patent No.: US 8,268,089 B2
(45) Date of Patent: Sep. 18, 2012

(54) DEVICE THAT SUPPLIES CLEAR RINSING AGENTS IN A PROGRAM-CONTROLLED DISHWASHER

(75) Inventors: Egbert Classen, Stahnsdorf (DE); Rüdiger Eiermann, Syrgenstein (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 92 days.

(21) Appl. No.: 12/687,901

(22) Filed: Jan. 15, 2010

(65) Prior Publication Data

US 2010/0108112 A1 May 6, 2010

Related U.S. Application Data

(62) Division of application No. 11/629,891, filed as application No. PCT/EP2005/053593 on Jul. 22, 2005, now Pat. No. 7,722,723.

(30) Foreign Application Priority Data

Jul. 23, 2004 (DE) ..... 10 2004 035 718

(51) Int. Cl.
*G01N 21/01* (2006.01)
*B08B 3/00* (2006.01)

(52) U.S. Cl. ..... 134/56 R; 134/56 D; 134/57 D; 134/58 D; 134/113; 356/436; 356/442

(58) Field of Classification Search ..... 134/56 R, 134/57 D, 58 D, 113, 56 D; 56/436, 440; 356/436, 440
See application file for complete search history.

(56) References Cited

U.S. PATENT DOCUMENTS

| | | | | |
|---|---|---|---|---|
| 4,257,708 | A | 3/1981 | Fukuda | |
| 6,509,558 | B1 * | 1/2003 | Loch et al. | 250/222.2 |
| 6,675,818 | B1 | 1/2004 | Schrott et al. | |
| 2005/0046826 | A1 | 3/2005 | Eiermann et al. | |
| 2006/0152730 | A1 * | 7/2006 | Schneider | 356/436 |

FOREIGN PATENT DOCUMENTS

| | | | |
|---|---|---|---|
| DE | 3303940 | A1 | 8/1984 |
| EP | 0653620 | A1 | 5/1995 |
| EP | 0966914 | A2 | 12/1999 |
| EP | 1188409 | * | 3/2002 |
| EP | 1188409 | A2 | 3/2002 |
| EP | 1362547 | A2 | 11/2003 |

OTHER PUBLICATIONS

International Search Report for PCT/EP2005/053593, Nov. 11, 2005.

* cited by examiner

*Primary Examiner* — Saeed T Chaudhry
(74) *Attorney, Agent, or Firm* — James E. Howard; Andre Pallapies

(57) ABSTRACT

A device for checking the concentration of clear rinsing agent in a rinsing liquid circulated in the means for retaining water of a household appliance is provided. The device includes a processing unit operatively connectable to a sensor having at least one transmitting element that emits an optical signal and at least one receiving element that receives the optical signal emitted by the transmitting element. The processing unit determines the wetting of the sensor with clear rinsing liquid and renders an estimate of the concentration of clear rinsing agent in the clear rinsing liquid as a function of the wetting of the sensor with clear rinsing liquid based upon the energy level emitted by the transmitting element and received by the receiving element.

14 Claims, 1 Drawing Sheet

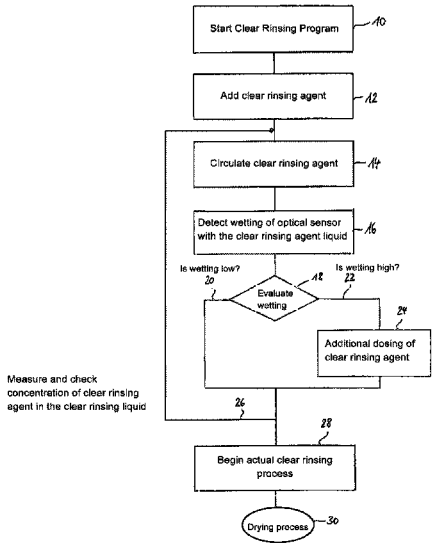

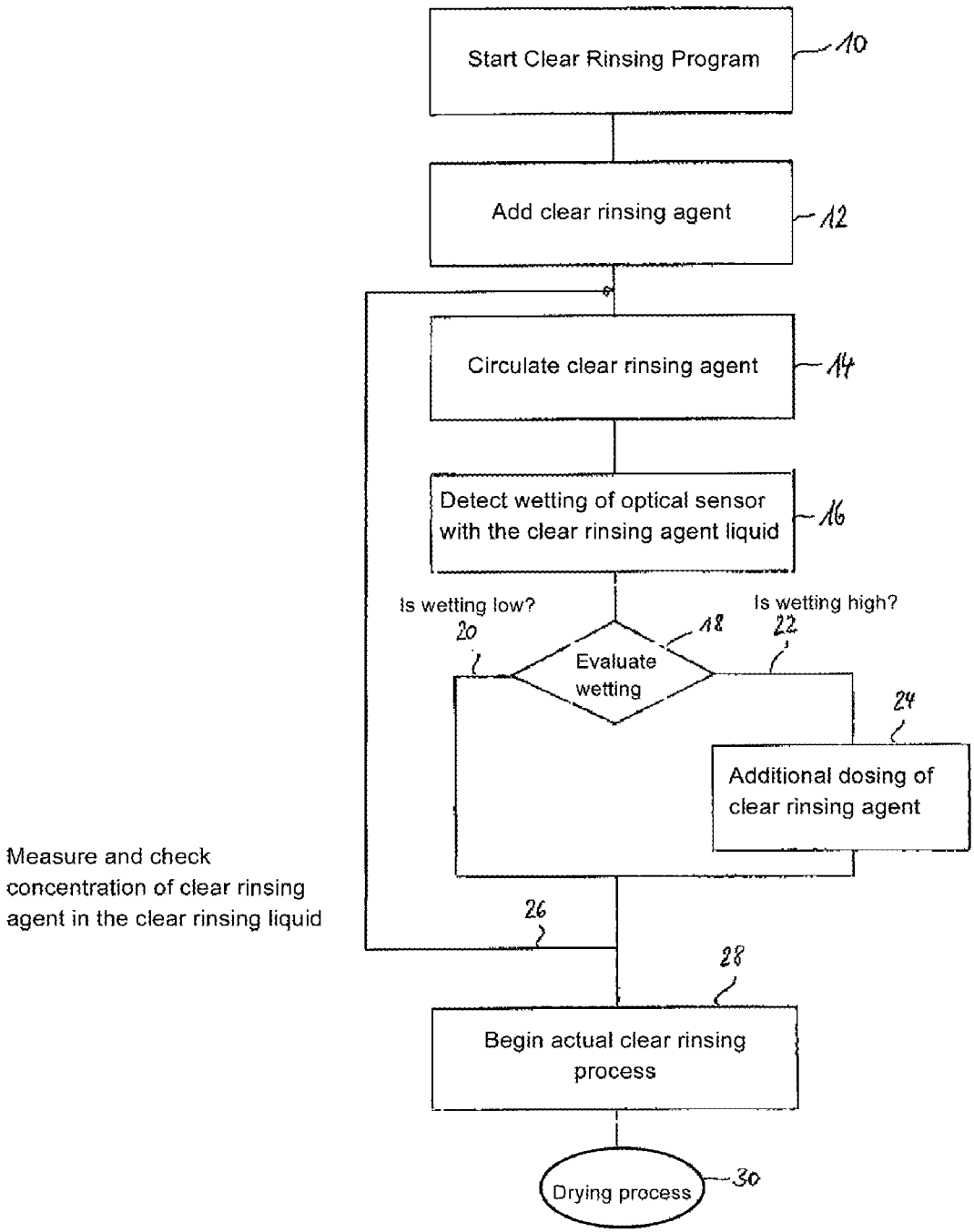
Start Clear Rinsing Program
10
Add clear rinsing agent
12
Circulate clear rinsing agent
14
Detect wetting of optical sensor with the clear rinsing agent liquid
16
Is wetting low?
Is wetting high?
20
18
22
Evaluate wetting
24
Additional dosing of clear rinsing agent
Measure and check concentration of clear rinsing agent in the clear rinsing liquid
26
28
Begin actual clear rinsing process
Drying process
30

DEVICE THAT SUPPLIES CLEAR RINSING AGENTS IN A PROGRAM-CONTROLLED DISHWASHER

CROSS-REFERENCE OF RELATED APPLICATIONS

This application is a Divisional, under 35 U.S.C. §121, of U.S. application Ser. No. 11/629,891, filed Dec. 15, 2006, which is a U.S. national stage application of PCT/EP2005/053593 filed Jul. 22, 2005, which designated the United States; this application also claims the priority, under 35 U.S.C. §119, of German patent application No. 10 2004 035 718.8 filed Jul. 23, 2004; the prior applications are herewith incorporated by reference in their entirety.

BACKGROUND OF THE INVENTION

The invention relates to a method for the dosed supply of clear rinsing agents to the clear rinsing liquid (rinsing solution) in the washing container of a program-controlled dishwashing machine in which the concentration of clear rinsing agent of the clear rinsing liquid is monitored by means of an optical sensor.

The washing program of a program-controlled dishwashing machine comprises several cleaning and rinsing processes which are completed with a clear rinsing process. In this case, a clear rinsing liquid provided with a clear rinsing agent is supplied to the cleaned crockery located in the washing container. The clear rinsing agent is frequently metered by the customer, in which case, however, the adjusted quantity is merely a rough value. On the one hand this can therefore result in overdosing and an unnecessarily high consumption of clear rinsing agent. If the dosing is inadequate, on the other hand, the desired clear rinsing effect is frequently not achieved. Manual dosing of the clear rinsing agent also cannot take into account the quality of the clear rinsing agent used.

Alternatively, so-called "3-in-1" combination preparations have been available for some time for use in dishwashing machines, these comprising a cleaning substance, a softening substance and a clear rinsing substance and being supplied simultaneously to the washing container of the dishwashing machine at a specific time. The combination preparations are available in compressed tablet form (so-called "tabs") and also in powder form. They can be inserted in dosing devices provided in the dishwashing machine. In this case, they are added to the washing container at a particular time which is determined by the washing program sequence of the dishwashing machine.

However, the known "3-in-1" combination preparations have the disadvantage that they dissolve differently depending on various parameters and accordingly have their highest efficiency at different times. For example, there are combination preparations which work according to a so-called "dilution principle", i.e. the combination preparation is added at the beginning of the cleaning process and begins to dissolve. In this case, the clear rinse agent is initially added in a high concentration, i.e., overdosed and it is assumed that as a consequence of entrainment in washing water residues and adhesion of the dissolved clear rinse agent on the items to be washed, on the walls of the washing container and also in the supply pipes, the concentration in the clear rinsing process is still sufficient to achieve a good drying result. However, combination preparations of this type have the disadvantage that when a plurality of washing program sections are carried out before the clear rinsing process, the combination preparation dissolves too quickly and as a result of the repeated change of rinsing liquid, said preparation is no longer present in sufficient concentration in the actual clear rinsing process.

Other combination preparations are designed so that initially only the cleaner and the softener dissolve and the clear rinse agent which is encapsulated in the combination preparation, e.g. in the form of a wax-sheathed pearl, only dissolves during the clear rinsing depending on the temperature and/or the pH. However, when using a washing program which already operates at high temperatures in the cleaning program section and/or where the duration of the cleaning process is selected to be very long, the clear rinse agent is already dissolved before the actual clear rinsing process.

To solve the problems described above, DE 102 57 826 A1 provides the use of at least one optical sensor which can detect the type of combination preparation used. Changes in concentration and/or pH and/or variations in the degree of hardness of the rinsing liquid are detected, allowing conclusions to be drawn on the concentration of the individual active substances.

In order to be able to encounter a particular concentration of clear rinsing agent in the clear rinsing process step, a defined volume of rinsing liquid is supplied to the washing container. This can be fixedly determined in advance or adjusted in a variable manner depending on various parameters. The concentration of the clear rinsing agent actually present in the rinsing liquid is used as an important quantity since this directly influences the clear rinsing result and therefore the drying result of the items to be washed. If the concentration of clear rinse agent at the beginning of the clear rinsing program section is low, as little rinsing liquid as possible is added, optionally depending on the degree of turbidity of the rinsing liquid. On the other hand, if the concentration of clear rinsing agent at the beginning of the clear rinsing program section is above-average or sufficiently high, the concentration of the clear rinsing agent can be adjusted to a pre-determined concentration by supplying a definedly adjustable volume of rinsing liquid.

In order to prevent overdosing of clear rinsing agents, DE 100 45 151 C2 proposes that the foam concentrations of the clear rinsing liquid is monitored by means of an optical sensor and compared with a set point for the foam concentration. When the predefined set point of the foam concentration is reached, the supply of clear rinsing agent is automatically reduced.

Furthermore, DE 100 34 546 A1 proposes the use of a radar sensor to determine the droplet size or shape or the status data of a test body wetted with the rinsing liquid in order to make predictions on the state of the rinsing liquid, for example, its content in the rinsing liquid.

SUMMARY OF THE INVENTION

It is the object of the invention to improve a method for the dosed supply of clear rinsing agent to the clear rinsing liquid in the washing container of a program-controlled dishwashing machine during the clear rinsing process in such a manner that underdosing of clear rinsing agent can be simply prevented in order to achieve an optimal drying result. Furthermore, a device for checking the concentration of clear rinsing agent in the rinsing liquid of a program-controlled water-carrying household appliance is to be provided.

These objects are achieved with a method, a device, and a water-carrying appliance having the features disclosed in the exemplary embodiments of the invention.

According to the invention, the wetting of the optical sensor with the clear rinsing liquid is used as a criterion for the dosed supply of clear rinsing agent. In other words, the determination of the wetting as a criterion for the concentration of clear rinsing agent in the clear rinsing liquid means checking the run-off behaviour of the clear rinsing liquid by the sensor. In particular, the droplet size and droplet shape can be checked by the sensor in order to obtain a prediction of the state of the clear rinsing liquid. The concentration of clear rinsing agent can be perceived in a variation of the surface tension of the clear rinsing agent. The run-off behaviour thereby induced can be detected by the optical sensor and used to determine the concentration of clear rinsing agent in the clear rinsing liquid. The concentration of clear rinsing agent determines the effect of the clear rinsing agent so that the effect of the clear rinsing agent can also be detected.

Subsequently, a comparison is made with a desired value of a wetting of the optical sensor at an ideal concentration of clear rinsing agent in the clear rinsing liquid during the clear rinsing process. If the difference determined between the desired value of the wetting and the measured wetting of the optical sensor is too large, clear rinsing agent can be added to the washing container from a supply of clear rinsing agent until the required concentration of clear rinsing agent is achieved.

The device for checking the concentration of clear rinsing agent in a rinsing liquid of a program-controlled water-carrying household appliance comprises a sensor comprising at least one transmitting element which emits an optical signal and at least one receiving element which receives the optical signal emitted by the transmitting element as well as a processing unit. According to the invention, the processing unit is set up to determine the wetting of the sensor with clear rinsing liquid and from this the concentration of clear rinsing agent in the clear rinsing liquid from the energy level emitted by the transmitting element and received by the receiving element. The concentration of clear rinsing agent determines the effect of the clear rinsing agent so that the effect of the clear rinsing agent is also detected by the concentration of clear rinsing agent.

The device according to the invention for checking the concentration of clear rinsing agent is preferably installed in a water-carrying appliance, in particular a dishwashing machine, where the device can be arranged on the side of the door assigned to the washing chamber or a wall of the washing chamber. Depending on the design of the sensor, the device for checking the concentration of clear rinsing agent can be arranged on the roof or on the bottom of the washing chamber.

The sensor preferably comprises a transparent element into which the transmitting element couples the optical signal and the receiving element receives the optical signal coupled out from the transparent element. The wetting of this transparent element of the sensor with clear rinsing agent is determined as the criterion for the concentration of clear rinsing agent in the clear rinsing liquid. In this case, the run-off behaviour at the transparent element is detected in a simple manner by the transmitting and receiving element.

By determining the clear rinsing agent depending on the requirement, depending on the concentration of clear rinsing agent determined in the clear rinsing liquid, a perfect drying result can be achieved, and overdosing or underdosing of clear rinsing agent can be prevented at the same time.

In the method according to the invention, the change in the concentration of clear rinsing agent in the clear rinsing liquid is appropriately measured by the sensor using the transmitting element which emits optical signals and the receiving element which receives the optical signals, wherein a light beam from the transmitting element of the sensor is coupled into the transparent element and the light beam emerging from the transparent element is measured by the receiving element of the sensor. The term light beam is to be understood generally as an electromagnetic wave and not restricted to particular wavelengths. Suitable sensors which are proposed for detecting lime deposits however, are known, for example from DE 198 25 981 A1 and DE 102 08 214 A1. However, the signals delivered by the sensors are evaluated at a different time compared with the method according to the invention. Any lime deposition which may occur can only be detected at the onset of the drying process. However, the sensor principle used in these sensors can be applied in an adapted manner to detect the wetting of the sensor in the invention.

It is particularly preferable if the transparent element has two end surfaces, as described in DE 102 08 214 A1, and is configured in such a manner that the element emitting the optical signal and the element receiving the optical signal are directly adjacent to the end surfaces of the transparent element so that the end surfaces are always free from any coating.

The light emitted by the optical-signal-emitting element, e.g. infrared light, enters into the transparent element and is reflected as a reflection taking place in the transparent element at the interface between the transparent element and the surrounding atmosphere in such a manner that the light ray or the light beam substantially emits with scattering losses through the transparent element and finally emerges through the second end surface assigned to the receiving element and enters the receiving element. The total reflection taking place in the transparent element produces a brightness value which corresponds to a particular energy value. The magnitude of the energy difference between the optical-signal-emitting element and the optical-signal-receiving element is based on a certain irradiation performance of the transparent element and is appropriately taken into account during the processing of the signal value.

As soon as the transparent element is wetted by the rinsing liquid and optionally adheres to the transparent element for a certain time as a result of deficient clear rinsing agent, the refractive index between the transparent element and the directly adjacent deposition layer is varied at these regions in such a manner that the number of total reflections at the interface of the transparent element decreases. If the light ray or light beam is incident at a certain angle at the interface of the transparent element and if this region of the transparent element is covered with clear rinsing liquid, a certain fraction of the light beam emerges from the transparent element or is deflected and is not reflected into the transparent element. Since the receiving element measures the energy intensity or the luminous intensity of the light emerging from the transparent element, the receiving luminous intensity is related to a corresponding wetting on the transparent element.

After a certain threshold value for wetting has been determined, clear rinsing agent is optionally added depending on the information which has been determined.

Preferably not only an instantaneous value is determined when determining the wetting of the optical sensor but the wetting of the transparent element with the rinsing liquid is determined as a function of time in order to obtain an accurate prediction of the concentration of clear rinsing agent in the clear rinsing liquid and to be able to take into account the run-off behaviour of the sensor or the transparent element.

In a further advantageous embodiment, it is provided that the clear rinsing liquid is first circulated and a renewed measurement of the concentration of the clear rinsing agent in the clear rinsing liquid is then made to check whether clear rinsing agent has been added. The circulation ensures that added clear rinsing agent can mix with the clear rinsing liquid. This can avoid the falsification of a measurement result by any regions of concentrated clear rinsing agent which may occur in the clear rinsing liquid.

The determination of the concentration of clear rinsing agent in the clear rinsing liquid is preferably made iteratively until a predetermined value of the concentration of clear rinsing agent in the clear rinsing liquid is reached.

In a further advantageous embodiment, the sequence of the clear rinsing process is adapted depending on the concentration of clear rinsing agent in the rinsing liquid. In other words, this means that the dosing of clear rinsing agent, circulation and measurement of the concentration of clear rinsing agent takes place until the desired concentration of clear rinsing agent is achieved in the clear rinsing liquid. Only then is the actual clear rinsing program continued.

BRIEF DESCRIPTION OF THE DRAWINGS

The invention is explained in detail with reference to an exemplary embodiment of an automatic dosed supply of clear rinsing agent in a dishwashing machine, shown as a flow diagram in the drawings.

DETAILED DESCRIPTION OF THE EXEMPLARY EMBODIMENTS OF THE PRESENT INVENTION

The dishwashing machine receives the crockery to be washed in a washing container. A program controller takes over the sequence of the cleaning and washing processes with the supply, heating and removal of the cleaning and rinsing liquid in a known manner and is therefore not described in detail.

The end of the cleaning and washing processes is followed by a clear rinsing process in which clear rinsing liquid and clear rinsing agent are supplied to the washing container. Assigned to the washing container is at least one optical sensor which monitors the concentration of clear rinsing agent in the clear rinsing liquid and delivers a corresponding actual value to a processing unit of the program controller. As long as the actual value does not reach the desired value stored in the processing unit, the processing unit delivers a signal to a dosing device which supplies a clear rinsing agent to the clear rinsing liquid continuously or at intervals. If the actual value detected by the optical sensor corresponds to the predefined desired value, no clear rinsing agent is then supplied.

The individual process sequence is configured as follows. The start of the clear rinsing program begins in process step 10. In the next step clear rinsing agent is added to the clear rinsing agent liquid of the dishwashing machine (step 12). The clear rinsing agent can be dosed by means of the "3-in-1" combination preparations mentioned initially or in a known manner by means of a clear rinsing agent reservoir. In order to achieve a good distribution of the clear rinsing agent in the clear rinsing agent liquid, the clear rinsing agent liquid is then circulated in a known fashion (step 14). In this process step, the clear rinsing agent liquid flushes around the optical sensor present in the washing container. The optical sensor is arranged in the washing chamber in such a manner that the clear rinsing agent liquid can run off again from the optical sensor. The wetting of the optical sensor with the clear rinsing agent liquid is detected during this run-off (step 16).

Preferably those sensors in which a transparent element is arranged between a transmitting element and a receiving element are used for measuring the wetting. Appropriately, the transparent element is arranged in an area of the washing chamber which allows flushing with the clear rinsing liquid. Thus, the transparent element could be arranged in a chamber-like region having at least one opening which opens into the interior of the washing container and which has a valve suitable for emptying the chamber-like region again. The shape of the transparent element is in principle arbitrary. A rod-shaped or helical shape which allows a longer light path for the measurement has proved to be expedient. It is also feasible to arrange a plurality of transparent elements between the transmitting and receiving element since the light spectrum can then be selected to be broader. The preferred infrared range in the individual transparent elements and the associated optical-signal-transmitting/receiving elements could thus be varied.

The physical phenomenon forming the basis of the device according to the invention is based on a comparison of the light level coupled into the transparent element by the transmitting element with an energy level detected by the receiving element during coupling-out from the transparent element. If the transparent element exhibits no wetting, substantially all the light rays coupled into the transparent element by the transmitting element are reflected as a result of total reflection between the transparent element and the surrounding atmosphere before they reach the receiving element and do not leave the transparent element. As a result, the energy level coupled into the transparent element substantially corresponds to the energy level coupled out from the transparent element.

If the transparent element is flushed with clear rinsing liquid, a certain energy level will be coupled in by the transmitting element during irradiation of the transparent element and a different energy level will be received by the receiving element. According to the extent of the wetting with clear rinsing liquid, it should be established that the energy level detected by the receiving element is substantially lower than the energy level coupled in by the transmitting element.

Clear rinsing liquid provided with an optimal amount of clear rinsing agent will only cause wetting for a very short time at the sensor or the transparent element. In contrast, clear rinsing agent liquid having a too-low dosing of clear rinsing agent will adhere to the sensor or the transparent element for a longer time before it runs off. This time difference is used to measure the wetting of the sensor or the transparent element. The measurement is either made continuously for a particular time to detect the run-off behaviour of the clear rinsing liquid from the sensor or the transparent element. Alternatively, a plurality of measurements can be made at short consecutive time intervals. By comparing the energy level over time, it is possible to predict the wetting of the sensor or the transparent element and therefore the amount of clear rinsing agent in the clear rinsing liquid. The measured values can be evaluated using (threshold) values stored in the processing unit or on the basis of calculations.

In the flow diagram the wetting is evaluated in the process step characterised by the reference numeral 18. If the wetting is low (reference numeral 20), the actual clear rinsing process can begin with a further circulation according to process step 28 and subsequent drying process. If the wetting was high (reference numeral 22), additional dosing of clear rinsing agent, e.g. from a clear rinsing agent reservoir, is carried out in process step 24. Before the actual clear rinsing process (reference numeral 28) begins, another step involving measurement and checking the concentration of clear rinsing agent in the clear rinsing liquid takes place (reference numeral 26). This again comprises circulation according to process step 14, measurement of the wetting according to process step 16 and evaluation of the wetting according to step 18 in the manner described above.

The automatic supply of the ideal quantity of clear rinsing agent limits the quantity of clear rinsing agent to the required amount and ultimately results in a saving of said rinsing agent. In addition, an ideal drying result is achieved for the consumer.

The invention claimed is:

1. A device for checking a concentration of clear rinsing agent in a rinsing liquid of a program-controlled water-carrying household appliance, the device comprising:

a processing unit operatively connectable to a sensor having at least one transmitting element that emits an optical signal and at least one receiving element that receives the optical signal emitted by the transmitting element, the processing unit being operable to determine a wetting of the sensor with clear rinsing liquid and to render an estimate of the concentration of the clear rinsing agent in the clear rinsing liquid as a function of run-off behavior of the wetting of the sensor with the clear rinsing liquid, the processing unit determining the wetting of the sensor with the clear rinsing liquid and rendering an estimate of the concentration of the clear rinsing agent in the clear rinsing liquid based upon an energy level emitted by the transmitting element and received by the receiving element.

2. The device according to claim 1, wherein a reference value for the run-off behaviour of the clear rinsing liquid is stored by the sensor in the processing unit and is used for a comparison with the run-off behavior of the wetting of the sensor which has been determined by the processing unit.

3. The device according to claim 1, wherein the sensor has a transparent element into which the transmitting element couples the optical signal and the receiving element receives the optical signal coupled out from the transparent element.

4. The device according to claim 3, wherein the energy level corresponds to a brightness value produced at the transparent element.

5. The device according to claim 1, wherein the processing unit is operable to render the estimate of the concentration of the clear rinsing agent in the clear rinsing liquid as the function of the run-off behavior of the wetting of the sensor with the clear rinsing liquid continuously over a period of time.

6. The device according to claim 1, wherein the processing unit is operable to render the estimate of the concentration of the clear rinsing agent in the clear rinsing liquid as the function of the run-off behavior of the wetting of the sensor with the clear rinsing liquid at consecutive time intervals.

7. A water-carrying appliance, comprising:

means for retaining water during an operational cycle of the water-carrying appliance; and a device for checking a concentration of clear rinsing agent in a clear rinsing liquid circulated in the means for retaining water, the device including:

a processing unit operatively connectable to a sensor having at least one transmitting element that emits an optical signal and at least one receiving element that receives the optical signal emitted by the transmitting element, the processing unit being operable to determine a wetting of the sensor with the clear rinsing liquid and to render an estimate of the concentration of the clear rinsing agent in the clear rinsing liquid as a function of run-off behavior of the wetting of the sensor with the clear rinsing liquid and the processing unit determining the wetting of the sensor with the clear rinsing liquid and rendering an estimate of the concentration of the clear rinsing agent in the clear rinsing liquid based upon an energy level emitted by the transmitting element and received by the receiving element.

8. The water-carrying appliance according to claim 7, wherein the water-carrying appliance is a dishwashing machine.

9. The water-carrying appliance according to claim 7, wherein the water-carrying appliance is a household appliance.

10. The water-carrying appliance according to claim 7, wherein a reference value for the run-off behaviour of the clear rinsing liquid is stored by the sensor in the processing unit and is used for a comparison with the run-off behavior of the wetting of the sensor which has been determined by the processing unit.

11. The water-carrying appliance according to claim 7, wherein the sensor has a transparent element into which the transmitting element couples the optical signal and the receiving element receives the optical signal coupled out from the transparent element.

12. The water-carrying appliance according to claim 11, wherein the energy level corresponds to a brightness value produced at the transparent element.

13. The water-carrying appliance according to claim 7, further comprising:

a dosing device that supplies clear rinsing agent to the clear rinsing liquid in the means for retaining water, wherein the processing unit delivers a signal to the dosing device to supply clear rinsing agent to the clear rinsing liquid based on the estimate of the concentration of the clear rinsing agent in the clear rinsing liquid.

14. A program-controlled water-carrying household appliance, comprising:

a washing chamber for retaining water during an operational cycle of the water-carrying appliance; and a device that monitors a concentration of clear rinsing agent in a rinsing liquid in the washing chamber, the device comprising:

a sensor having at least one transmitting element that emits an optical signal and a receiving element that receives the optical signal emitted by the transmitting element, the sensor arranged in the washing chamber in such a manner that the clear rinsing liquid wets the sensor and runs off the sensor;

a processing unit operatively connected to the sensor and receiving from the sensor an energy level of the optical signal emitted by the transmitting element and received by the receiving element during run-off of the clear rinsing liquid from the sensor, the processing unit programmed to determine, based on the received energy level, a wetting of the sensor with the clear rinsing liquid and render an estimate of the concentration of the clear rinsing agent in the clear rinsing liquid as a function of run-off behavior of the wetting of the sensor with the clear rinsing liquid.

* * * * *